United States Patent [19]

Jimenez

[11] 4,212,256

[45] Jul. 15, 1980

[54] DETACHABLE SOLE PLATE

[75] Inventor: Antonio Jimenez, Meyrin, Switzerland

[73] Assignee: Mefina S.A., Fribourg, Switzerland

[21] Appl. No.: 963,469

[22] Filed: Nov. 20, 1978

[30] Foreign Application Priority Data

Nov. 25, 1977 [CH] Switzerland ..... 14468/77

[51] Int. Cl.[2] ..... D05B 29/00; D05B 29/12

[52] U.S. Cl. ..... 112/240

[58] Field of Search ..... 112/235, 240, 60, 61; 403/166

[56] References Cited

U.S. PATENT DOCUMENTS

| | | | |
|---|---|---|---|
| 1,370,862 | 3/1921 | Vasger | 403/166 |
| 2,045,395 | 6/1936 | Leindorf | 403/166 |
| 3,143,094 | 8/1964 | Yamada | 112/235 |
| 3,145,674 | 8/1964 | Kurihara | 112/240 |
| 3,161,264 | 12/1964 | Isaacson | 403/166 X |
| 3,326,160 | 6/1967 | Murino | 112/240 |
| 3,457,889 | 7/1969 | Killinger et al. | 112/240 |
| 3,506,135 | 4/1970 | Klingaman | 403/166 X |
| 3,511,199 | 5/1970 | Howell | 112/235 |
| 3,638,595 | 2/1972 | Casas-Robert | 112/235 |
| 3,724,406 | 4/1973 | Fresard et al. | 112/235 |
| 3,836,174 | 9/1974 | Holman, Jr. | 403/166 X |
| 4,136,626 | 1/1979 | Kandou et al. | 112/235 |

FOREIGN PATENT DOCUMENTS

| | | | |
|---|---|---|---|
| 7310457 | 10/1974 | France | 403/166 |

*Primary Examiner*—Werner H. Schroeder
*Assistant Examiner*—Andrew M. Falik
*Attorney, Agent, or Firm*—Emory L. Groff, Jr.

[57] ABSTRACT

A sewing machine presser foot is provided with a detachable sole plate connected to the spaced apart arms of a support member by means of a compressible pin assembly secured to the arms and projecting from the sides thereof. The sole plate is provided with inclined flanges on its upper surface and aligned openings beneath the flanges. When the sole plate is moved upwardly toward the support member the projecting ends of the pin assembly are engaged by the ramps and compressed toward each other to permit the projecting ends to engage in the openings in the sole plate upon release of the compressive force on said ends.

4 Claims, 2 Drawing Figures

DETACHABLE SOLE PLATE

This invention relates to a presser foot for a sewing machine wherein the sole plate of the presser foot is readily detachable from its support.

Known sewing machine presser feet comprise a sole plate pivoted on a transverse axis in a support held against the presser bar by a securing member including an opening in which a screw is engaged and screwed into a threaded opening of the presser bar.

When it is desired to substitute a sole plate adapted for special work such as sewing hems or buttons, for example, for a sole plate used for ordinary sewing it is necessary to unscrew the presser foot assembly and replace it with another presser foot which includes the desired sole member.

It has already been proposed to simplfy this operation by providing a series of detachable sole plates which are removable from the aforementioned support. However, these detachable sole members usually fit very loosely when fixed in position which is detrimental to the sewing operation.

In order to obviate this inconvenience, the presser foot according to the present invention is characterized in that it comprises a pin which is compressible in a longitudinal direction said pin being fixed relative to said support, a sole plate having a raised longitudinally extending flange on each side of its upper face, each of the flanges having a hole in axial alignment with each other and a ramp on the upper inner face of each flange for guiding the ends of said pin into said holes. The ramps are inclined toward one another in a direction toward said holes so as to assure introduction of the ends of the pin into the holes by compression of the ends of said pins.

The attached drawing shows schematically and by way of example a preferred form of execution of a presser foot according to the present invention.

Figure 1:
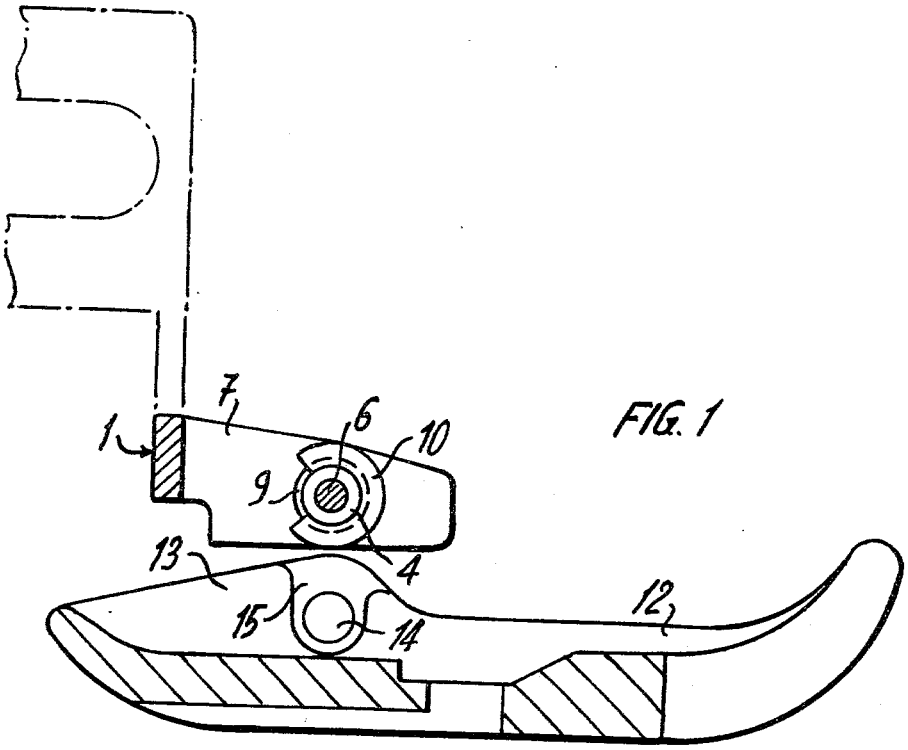
FIG. 1 shows a side elevation, partly in section, of a sole plate beneath its support prior to assembly therewith.

The support 1 of the pressure foot is provided with a cross pin assembly 2 which is compressible in a longitudinal direction against the action of a spiral spring 3. The pin assembly includes a pin 6 provided with two substantially hemispherical caps 4 and 5 mounted on its ends, said caps slidable along the pin against the action of the spiral spring 3 when the pin assembly is compressed. The lower part of the support 1 comprises a fork whose arms 7 and 8 each are provided with a bore 9 in which the caps 4 and 5 of the pin 6 are engaged when assembled with the support. Circlips 10 mounted in a peripheral groove 11 near the open end of each cap comprise a stop against which the inner faces of the arms 7 and 8 may engage as shown at the top of FIG. 2.

The sole plate 12 is provided with a raised longitudinally extending flange 13 on its upper face along each of its longitudinal edges. Each of the flanges 13 are provided with a transverse bore 14, the respective bores being in alignment with one another. The flanges 13 are each provided in an area above the bore 14 with a ramp 15 inclined toward the ramp in the other flange 13.

Figure 2:
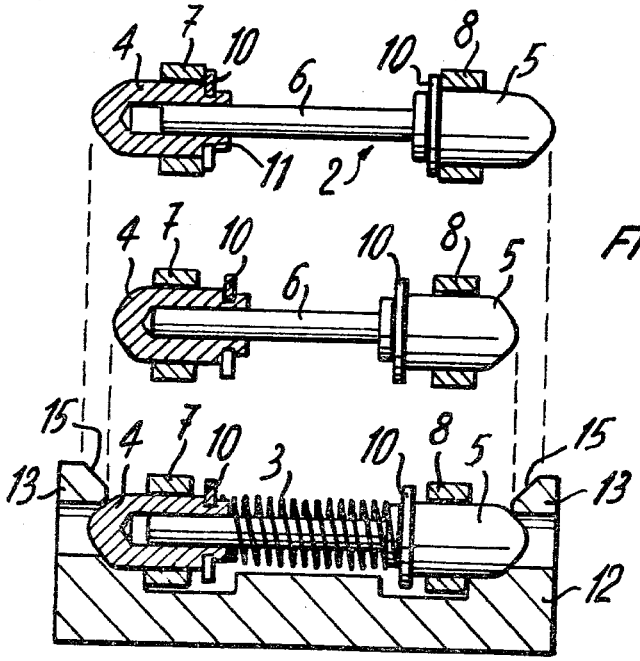
FIG. 2 is a front elevation, partly in section, showing the pin in its assembled position with the support and in its extended and contracted positions prior to and during assembly respectively.

As shown in FIG. 2, the distance between the upper ends of the ramps 15 of the sole plate 12 with regard to one another is less than the length of the pin assembly 2 in its extended position as it is mounted in the arms 7 and 8 of the support 1. In order to attach the sole plate 12 to the support 1, it is merely necessary to guide the substantially hemispherical ends of each of the caps 4 and 5 along the ramps 15 of the sole plate in a direction toward the respective bores 14 in order to compress the pin assembly and permit the caps 4 and 5 to snap into the bores 14 upon expansion of spring 3.

It is thus possible to obtain a quick connection between the support 1 and the sole plate 12 which is sufficiently effective to permit raising the entire presser foot when raising the presser bar to which it is fixed, into a higher position. One can thus, without unscrewing support 1 from the presser bar substitute for the sole plate 12 detached from support 1, another sole plate having the same ramps 15 and bores 14.

Numerous variations of the form of execution described above and shown on the drawing can be foreseen.

The pin assembly could, for example, comprise two tubular elements of which one of the ends of each is closed and is of substantially hemispherical shape, a spring being disposed in the interior of said tubular elements which are telescoped one within the other.

I claim:

1. A sewing machine presser foot including a sole plate and a support therefor, said support including a pair of spaced arms, each of said arms provided with a bore, a pin assembly compressible in a longitudinal direction and fixed in said bores of the arms of said support, said sole plate being attachable to and detachable from said pin assembly and including a flange on its upper face extending along each of its longitudinal edges, each said flange having an opening therein, said openings being aligned with each other, the ends of said pin assembly being of substantially hemispherical shape and of a greater diameter than the diameter of said openings, a ramp on each flange above each of said openings, said ramps being inclined toward each other whereby they guide said pin assembly into said openings when the ends of said pin assembly are engaged by said ramps and moved toward said openings.

2. A presser foot according to claim 1, wherein the pin assembly includes caps mounted on the ends of said pin, a spring between said caps, said caps slidable axially on said pin against the action of said spring.

3. A presser foot according to claim 2, wherein the caps are engaged in the bores in said arms, said bores being of the same diameter as said caps, said caps each provided with an abutment for engagement with the inner faces of said arms.

4. A presser foot according to claim 3, wherein the diameter of said caps is greater than the diameter of the openings in said sole plate flanges.

* * * * *